US006748600B1

(12) United States Patent
Motooka et al.

(10) Patent No.: US 6,748,600 B1
(45) Date of Patent: Jun. 15, 2004

(54) BALL CATCHING TOOL

(75) Inventors: Ken Motooka, Osaka (JP); Masaki Terashita, Osaka (JP); Kazuhiro Kume, Osaka (JP)

(73) Assignee: Mizuno Corporation, Osaka (JP)

( * ) Notice: Subject to any disclaimer, the term of this patent is extended or adjusted under 35 U.S.C. 154(b) by 0 days.

(21) Appl. No.: 10/436,586

(22) Filed: May 13, 2003

(30) Foreign Application Priority Data

Dec. 9, 2002 (JP) ..... 2002-356144

(51) Int. Cl.[7] ..... A41D 13/08
(52) U.S. Cl. ..... 2/19; 2/161.1
(58) Field of Search ..... 2/19, 16, 20, 159, 2/160, 161.1, 161.6, 163, 169

(56) References Cited

U.S. PATENT DOCUMENTS 1,542,516 A * 6/1925 Myers ..... 2/19
5,636,381 A * 6/1997 Brogden ..... 2/161.1
5,974,587 A * 11/1999 Murai ..... 2/19
6,219,844 B1 * 4/2001 Yamada et al. ..... 2/19

FOREIGN PATENT DOCUMENTS

| | | |
|---|---|---|
| JP | 55-78969 | 6/1980 |
| JP | 57-109863 | 7/1982 |
| JP | 57-173772 | 11/1982 |
| JP | 2950319 | 9/1999 |

* cited by examiner

*Primary Examiner*—Gary L. Welch
(74) *Attorney, Agent, or Firm*—Troutman Sanders LLP; Gerald R. Boss; Ryan A. Schneider

(57) ABSTRACT

A ball catching tool includes an outer leather member and an inner leather member inserted in the outer leather member. The inner leather member is formed by coupling a palm-side inner leather portion and a back-side inner leather portion to each other, and has a plurality of thumb and finger portions receiving the thumb and the fingers respectively. An inter-digital extensional member is mounted on at least one portion between the bases of the finger portions. Thus, the extensional portion is provided between the bases of desired ones of the thumb and finger portions of the inner leather member for increasing the interval between the bases.

6 Claims, 8 Drawing Sheets

BALL CATCHING TOOL

This application claims priority under 35 U.S.C. §119 based on Japanese Patent Application Serial No. 2002-356144, filed on Dec. 9, 2002.

BACKGROUND OF THE INVENTION

1. Field of the Invention

The present invention relates to a ball catching tool such as a glove or a mitt for baseball or softball, and more particularly, it relates to the structure of a ball catching tool enabling a ball player to readily catch a ball.

2. Description of the Background Art

For example, Japanese Patent Laying-Open No. 55-78969 (1980), Japanese Utility Model Laying-Open No. 57-109863 (1982), Japanese Utility Model Laying-Open No. 57-173772 (1982) and Japanese Patent No. 2,950,319 disclose gloves for baseball or softball as exemplary conventional ball catching tools.

Japanese Patent Laying-Open No. 55-78969 describes a baseball glove formed by providing index and middle fingers, middle and ring fingers and the bases of merged portions between the index, middle and ring fingers at large intervals in a pocket-side inner leather member while continuously providing extensional members of the bases, folding the extensional members frontward and stitching the same on an outer leather member.

Japanese Utility Model Laying-Open No. 57-109863 describes a baseball glove formed by increasing the intervals between first to fourth finger cushions of a pocket-side outer leather member. In this baseball glove, strips provided on the bases of the finger cushions of the outer leather member are folded toward the back of the glove, while edge members provided along the outer peripheral edges of the finger cushions are detoured toward the back of the glove along the strips on the aforementioned bases so that the finger cushions and the strips are stitched on edges of a back-side leather member of the glove.

Japanese Utility Model Laying-Open No. 57-173772 describes a glove for baseball or softball formed by providing arcuate projections extending toward fingertips on the bases of interdigital portions of a pocket-side leather member and stitching the arcuate projections on finger stalls through a back-side leather member and reinforcing leather members so that the pocket-side leather member is expanded and the stitched portions are sunk on the bases of the interdigital portions provided with the arcuate projections. Japanese Patent No. 2,950,319 describes a baseball glove assembled by inserting an inner core bag into an outer bag. In this baseball glove, the outer bag is formed by a surface member and a back member, while a notch is provided between little and ring fingers extending from a palm portion of the surface member as an adjustable portion for defining a prescribed interval. A projection or a notch is provided between little and ring fingers of the back member for locating the ring finger backward with respect to the little finger of the surface member by the interval defined by the notch. The respective fingers are brought into contact with each other through the projection or the notch of the back member, which in turn is stitched on the surface member for assembling the baseball glove. Thus, a step is formed for locating a ring finger stall at the back of a pocket with respect to a little finger stall.

In the aforementioned baseball glove described in Japanese Patent Laying-Open No. 55-78969, the extensional members of the bases are stitched on the outer leather member in order to reinforce the fragile interdigital portions. However, the extensional members of the bases are not intended to fix the positions of the fingers of a ball player using this baseball glove, and hence the ball player cannot fix the positions of his/her fingers and adjust the intervals between the fingers. Therefore, the fingers may so unstably move in the glove that it is difficult to efficiently transmit the power of the base player's hand to the glove or the optimum position for catching a ball fluctuates. Therefore, the ball player using this baseball glove disadvantageously readily fails to catch the ball.

Japanese Utility Model Laying-Open No. 57-109863 disclosing the ball catching tool formed by merely increasing the intervals between the finger cushions of the outer leather member describes no means for fixing the positions of the fingers of a ball player using this glove. Therefore, the ball player cannot fix his/her fingers in the glove when catching a ball, and may readily fail to catch the ball similarly to the above.

Japanese Utility Model Laying-Open No. 57-173772 disclosing the baseball glove formed by merely stitching the arcuate projections on finger stalls describes no means of fixing the positions of the fingers of a ball player in the glove either. Therefore, the ball player cannot fix his/her fingers in this baseball glove when catching a ball, and may readily fail to catch the ball similarly to the above.

Japanese Patent No. 2,950,319 disclosing the baseball glove formed by merely locating the ring finger stall at the back of the pocket with respect to the little finger stall describes no means of fixing the positions of the fingers of a ball player in the glove either. Therefore, the ball player cannot fix his/her fingers in the glove when catching a ball, and may readily fail to catch the ball similarly to the above baseball gloves.

SUMMARY OF THE INVENTION

The present invention has been proposed in order to solve the aforementioned problems, and an object thereof is to provide a ball catching tool enabling a ball player to reduce the possibility of failing to catch a ball by fixing the positions of the fingers of the ball player in the ball catching tool.

The ball catching tool according to the present invention comprises an outer leather member and an inner leather member inserted in the outer leather member, while the inner leather member has a plurality of thumb and finger portions receiving the thumb and the fingers respectively, and an extensional portion is provided on at least one portion between the bases of the finger portions for extending the interval between the bases.

The interval between the bases of desired ones of the finger portions can be increased by providing the extensional portion between the bases of the finger portions of the inner leather member. A ball player inserting his/her hand into the inner leather member for wearing the ball catching tool provided with the extensional portion as described above can hold his/her fingers in a state spread on the extensional portion. Thus, the ball player can fix the positions of desired ones of the fingers in the ball catching tool.

The aforementioned thumb and finger portions preferably have upright portions uprighted from a palm-side inner leather portion and arranged in the vicinity of interdigital portions between the fingers. In this case, the aforementioned extensional portion is preferably provided between the upright portions.

The aforementioned inner leather member typically includes a palm-side inner leather portion located on the palm and a back-side inner leather portion located on the back. In this case, the palm-side inner leather portion preferably has an extensional member, which in turn is preferably stitched on the back-side inner leather portion for forming the extensional portion.

The aforementioned thumb and finger portions typically include a thumb portion receiving the thumb, an index finger portion receiving the index finger, a middle finger portion receiving the middle finger, a ring finger portion receiving the ring finger and a little finger portion receiving the little finger. In this case, the extensional portion may be provided between the base of the middle finger portion and the base of the ring finger portion, or between the base of the index finger portion and the base of the middle finger portion.

The aforementioned outer leather member preferably includes a plurality of thumb and finger stalls receiving the thumb and the fingers respectively, and a clearance is preferably provided between the bases of the finger stalls on a position corresponding to the aforementioned extensional portion.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
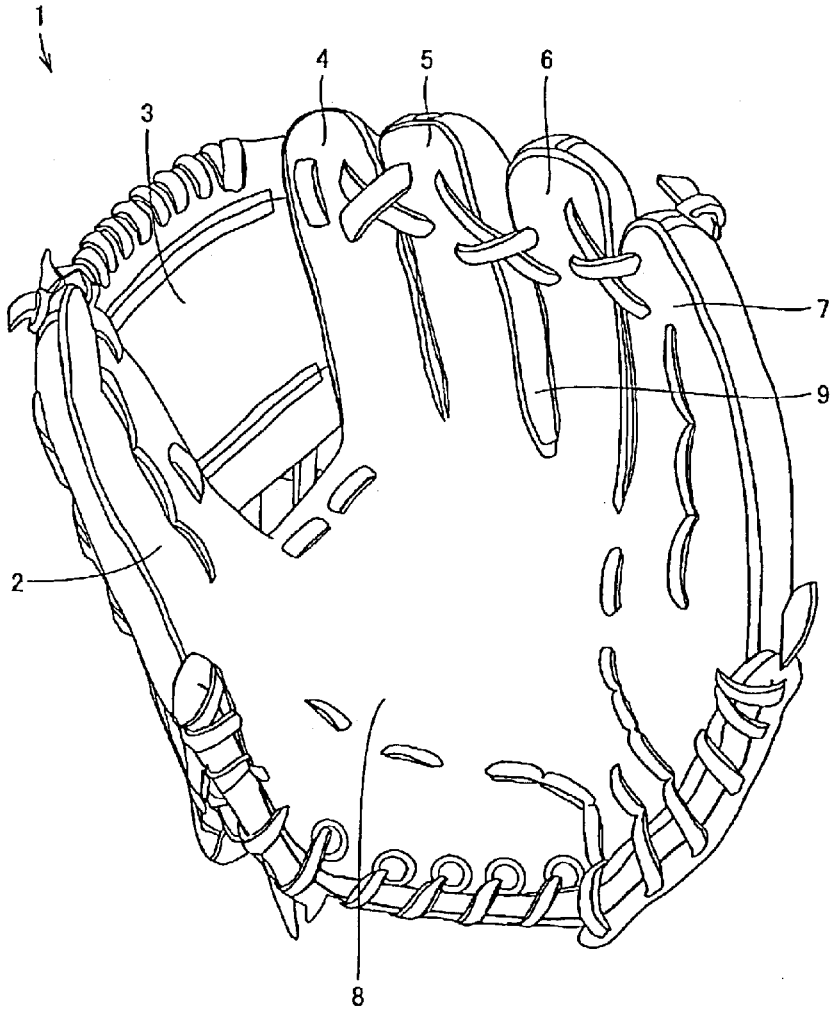
FIG. 1 is a front elevational view of a ball catching tool according to Example 1 of the present invention.

An embodiment of the present invention is now described. Throughout the specification, the term "ball catching tool" denotes a sporting good for catching a ball, such as a glove or a mitt for baseball of softball, for example.

The ball catching tool according to this embodiment typically comprises an outer leather member and an inner leather member inserted in the outer leather member. The outer leather member includes a palm-side outer leather portion located on the palm for forming a pocket receiving a ball and a back-side outer leather portion covering the back of the hand of a ball player. The inner leather member includes a palm-side inner leather portion located on the palm and a back-side inner leather portion located on the back. The ball catching tool is prepared by coupling the palm-side outer leather portion, the back-side outer leather portion, the palm-side inner leather portion and the back-side inner leather portion with each other.

A general ball catching tool comprises five thumb and finger stalls receiving the thumb and the fingers of a ball player respectively, a webbing portion provided between prescribed ones of the thumb and finger stalls and a hand receiving portion for receiving the ball player's hand in the ball catching tool. Some ball catching tool may have an opening partially exposing the back of the ball player's hand.

In the ball catching tool according to this embodiment, both of the outer leather member and the inner leather member have thumb and finger stalls or thumb and finger portions, and the outer and inner leather members are integrated with each other while inserting the thumb and finger portions (thumb and finger stalls) of the inner leather member into the thumb and finger portions (thumb and finger stalls) of the outer leather member. When wearing the ball catching tool, the ball player inserts his/her thumb and fingers into the thumb and finger portions (thumb and finger stalls) of the inner leather member.

The thumb and finger stalls include a thumb stall receiving the thumb, an index finger stall (first finger stall) receiving the index finger (first finger), a middle finger stall (second finger stall) receiving the middle finger (second finger), a ring finger stall (third finger stall) receiving the ring finger (third finger) and a little finger stall (fourth finger stall) receiving the little finger (fourth finger) respectively. A member for reinforcing the thumb or finger stall and rounding the same is mounted on the back surface of each of the thumb and finger stalls of the outer leather member. The webbing portion is typically provided between the thumb stall and the index finger stall. The hand receiving portion is formed by an opening provided on an end of the ball catching tool.

An important feature of the ball catching tool according to this embodiment resides in that an extensional portion is provided on at least one portion between the bases of the finger stalls (finger portions) of the inner leather member for extending the interval between the bases.

The extensional portion is so provided between the bases of desired ones of the finger portions of the inner leather member so that the ball player can increase the interval between the bases of desired ones of the finger portions. Thus, the ball player wearing the ball catching tool on his/her hand can increase the interval between desired. ones of the fingers due to the aforementioned extensional portion, for fixing the positions of desired ones of the fingers in the ball catching tool. Consequently, the ball player can inhibit the fingers from moving in the ball catching tool when catching a ball, efficiently transmit the power of his/her hand to the ball catching tool, and suppress fluctuation of the optimum position (pocket position) for receiving the ball. Thus, the ball player can be efficiently inhibited from failing to catch the ball.

Further, the ball catching tool can be brought into close contact with the ball player's hand due to the aforementioned extensional portion, thereby improving fittedness of the ball catching tool. Thus, the ball player can readily catch the ball with the ball catching tool.

The aforementioned extensional portion can be in an arbitrary structure so far as the same can extend the interval between the bases of desired ones of the finger portions of the inner leather member. For example, the aforementioned extensional portion may be prepared from part of the inner leather member, or some member may be mounted or attached between the bases of desired ones of the finger portions of the inner leather member. The member for forming the extensional portion may be made of a material identical to or different from that of the palm-side inner leather portion or the back-side inner leather portion.

When the aforementioned extensional portion is prepared from part of the inner leather member, an extensional member or piece for forming the extensional portion can be provided on the palm-side inner leather portion and stitched on the palm-side inner leather portion for forming the extensional portion.

The palm-side inner leather portion is cut into a shape similar to the planar shape of the ball player's hand, and has a plurality of extending portions brought into contact with the thumb and finger cushions of the ball player. The aforementioned extensional member may be provided between any of these extending portions. The extensional member can be formed to extend from between the bases of desired extending portions longitudinally along the extending portions. The extensional member is typically in the form of a strip, and rendered smaller in width than the extending portions. The interval between desired ones of the thumb and the fingers of the ball player can be adjusted in response to the width of the extensional member.

The interval between desired extending portions of the palm-side inner leather portion may conceivably be increased without providing the aforementioned extensional member, for locally extending the width of the palm-side inner leather portion and providing an extending portion having a width corresponding to that of the aforementioned extensional member. Also in this case, the extensional portion can be formed by coupling the extending portion with the palm-side inner leather portion.

When a separate member for forming the extensional portion is mounted between the bases of desired ones of the finger portions of the inner leather member, the width of the member may be rendered equivalent to that of the aforementioned extensional member or the aforementioned extending portion and coupled with the palm-side and back-side inner leather portions. Also in this case, the extensional portion can be formed between desired ones of the finger portions similarly to the above.

The thumb and finger portions of the inner leather member have space portions of prescribed sizes, to be capable of receiving the thumb and the fingers of the ball player. In order to define the space portions, the thumb and finger portions of the inner leather member have upright portions uprighted from the palm-side inner leather portion to reach portions close to interdigital portions. The aforementioned extensional portion is provided between the upright portions. Thus, the extensional portion can be arranged in the vicinity of the interdigital portions, so that the ball player can fix the positions of desired ones of his/her fingers in the ball catching tool while increasing the interval between the bases of the fingers.

The aforementioned extensional portion may be provided between the bases of the middle and ring finger portions, or between the bases of the index and middle finger portions. Further, the extensional portion(s) may be provided between the bases of the ring and little finger portions, between the bases of the middle and ring finger portions as well as between the bases of the index and middle finger portions, between the bases of the middle and ring finger portions as well as between the bases of the ring and little finger portions, between the bases of the index and middle finger portions as well as between the bases of the ring and little finger portions, or between the bases of all of the index, middle, ring and little finger portions.

When extensional portions are provided between the bases of a plurality of finger portions, it is also possible to properly adjust the intervals between the bases of the finger portions by varying the widths of the extensional portions so that the ball player can most suitably shape his/her hand for catching a ball by simply inserting his/her hand into the ball catching tool. The shape of the hand varies with the ball player, and hence it is also possible to provide a ball catching tool suitable to each ball player.

In addition to the aforementioned extensional portion provided between the bases of desired ones of the finger portions of the inner leather portion, a clearance may be provided between the bases of the finger stalls of the outer leather member on a position corresponding to the aforementioned extensional portion. In this case, the inner and outer leather members are integrated with each other so that the ball player can transmit movement of his/her thumb and fingers to the ball catching tool without any loss when catching a ball. This can also contribute to simplification of catching.

When the extensional portion is provided between the bases of the middle and ring finger portions of the inner leather member and the aforementioned clearance is provided on the outer leather member in correspondence to the extensional portion, the optimum position (pocket portion) for receiving a ball in the central portion of the outer leather member is spread so that the ball catching tool is suitable for an infielder. In this case, the middle and ring fingers slightly spread in the ball catching tool and hence the ball player can smoothly move the fingers around the center of the ball catching tool.

When the extensional portion is provided between the bases of the index and middle finger portions of the inner leather member and the aforementioned clearance is provided on the outer leather member in correspondence to the extensional portion, the ball catching tool is spread between the index finger stall of the outer leather member and the middle finger stall of the outer leather member. Therefore, the ball catching tool is suitable for an outfielder catching a ball in a holding manner. Further, the middle finger stall slightly opens about the index finger stall of the outer leather member, and hence the ball player can readily move his/her middle, ring and little fingers in the ball catching tool for readily closing the ball catching tool Examples of the present invention are now described with reference to FIGS. 1 to 8.

EXAMPLE 1

Figure 2:
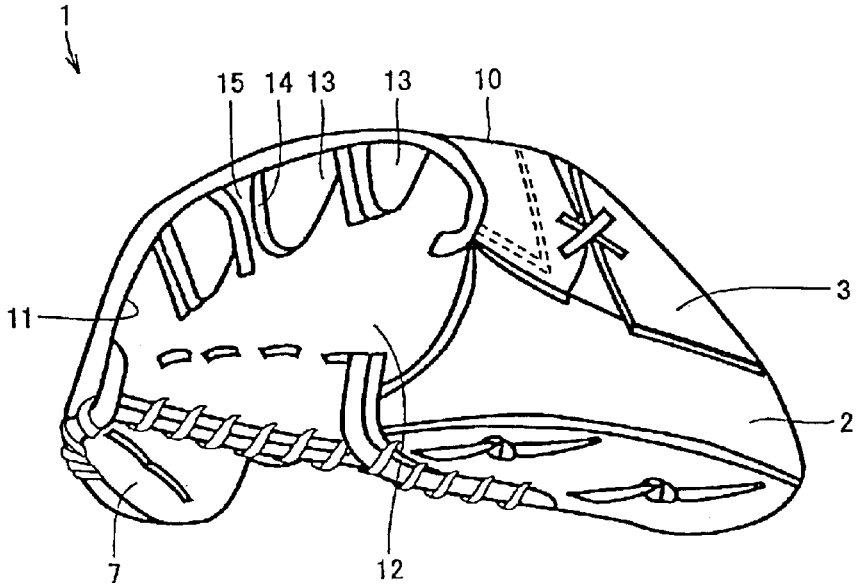
FIG. 2 illustrates the internal structure of the ball catching tool according to Example 1 of the present invention.

As shown in FIGS. 1 and 2, a ball catching tool 1 according to Example 1 of the present invention is a glove for baseball or softball, which comprises an outer leather member formed by coupling a palm-side outer leather portion 8 including a ball receiving part and a back-side outer leather portion 10 including a back part to each other with straps or the like. The outer leather member is made of a material mainly prepared from natural or artificial leather, for example.

The outer leather member includes a thumb stall 2 receiving the thumb, an index finger stall (first finger stall) 4 receiving the index finger, a middle finger stall (second finger stall) 5 receiving the middlefinger, a ring finger stall (third finger stall) 6 receiving the ring finger, a little finger stall (fourth finger stall) 7 receiving the little finger, a webbing portion 3 provided between the thumb stall 2 and the index finger stall 4 and a hand receiving portion for introducing the hand of a ball player into the ball catching tool 1.

As shown in FIG. 2, the ball catching tool 1 according to Example 1 has an opening 11 provided on the back-side outer leather portion 10 for partially exposing the back of the ball player's hand, while this opening 11 can be omitted. For the convenience of illustration, FIG. 2 omits portions located closer to the ball player's wrist than the opening 11.

As shown in FIG. 1, the interval between the bases of the middle and ring finger stalls 5 and 6 is rendered larger than those between the bases of the index and middle finger stalls 4 and 5 and between the bases of the ring and little finger stalls 6 and 7, while a clearance 9 is defined between the bases of the middle and ring finger stalls 5 and 6 in the ball catching tool 1 according to Example 1.

An inner leather member is inserted into the aforementioned outer leather member. The inner and outer leather members are coupled to each other with straps or the like, thereby forming the ball catching tool 1 according to Example 1.

Figure 4:
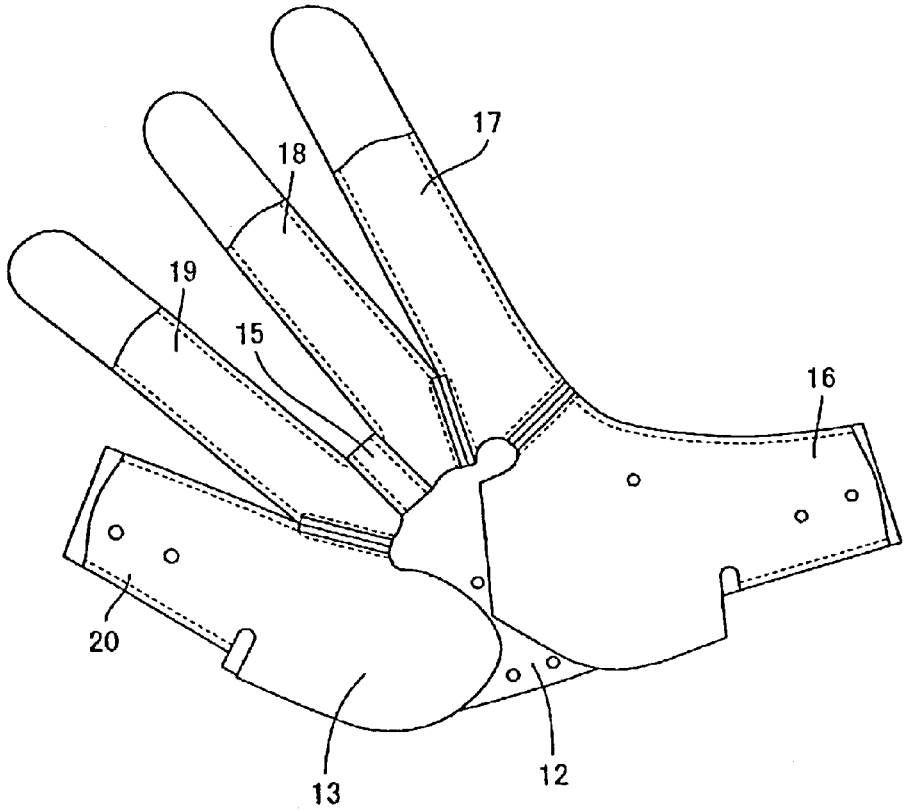
FIG. 4 is a plan view of an inner leather member employable for the ball catching tool according to Example 1 of the present invention.

FIG. 4 shows an exemplary shape of the inner leather member. As shown in FIG. 4, the inner leather member is formed by stitching a palm-side inner leather portion 12 arranged on the palm and a back-side inner leather portion 13 arranged on the back with each other. This inner leather member has a thumb portion 16 receiving the thumb, an index finger portion (first finger portion) 17 receiving the index finger, a middle finger portion (second finger portion) 18 receiving the middle finger, a ring finger portion (third finger portion) 19 receiving the ring finger and a little finger portion (fourth finger portion) 20 receiving the little finger respectively. These thumb and finger portions 16 to 20 are substantially in the form of bags having open forward ends.

Figure 3:
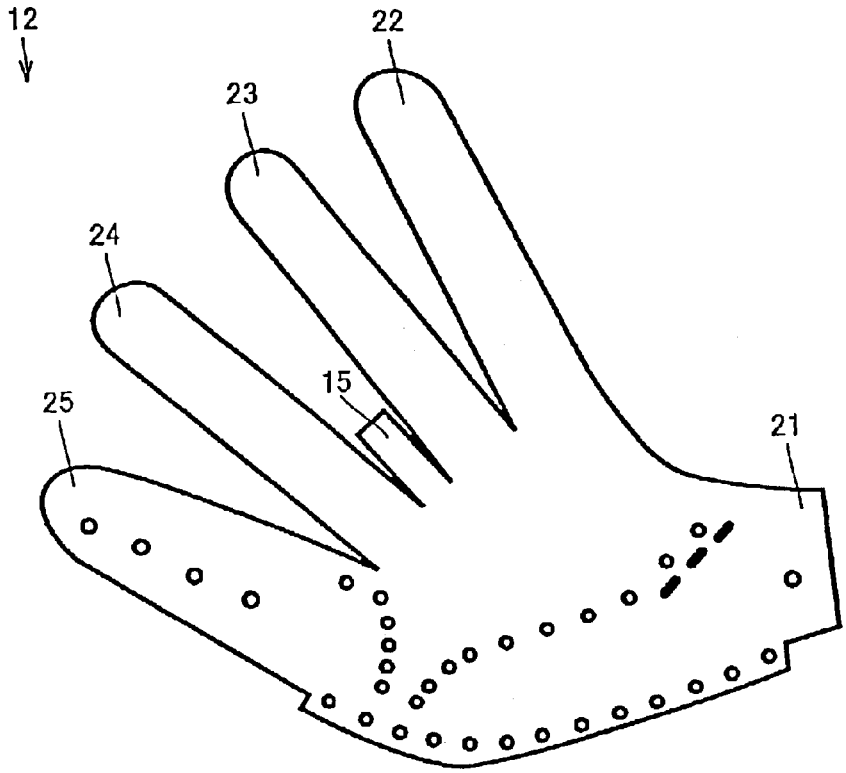
FIG. 3 is a plan view of a palm-side inner leather portion of the ball catching tool according to Example 1 of the present invention.

As shown in FIG. 3, the palm-side inner leather portion 12 is shaped in correspondence to the shape of the hand and has a plurality of extending portions 21 to 25 coming into contact with the thumb and finger cushions of the ball player. These extending portions 21 to 25 come into contact with the cushions of the thumb, the index finger, the middle finger, the ring finger and the little finger of the ball player respectively. According to Example 1, an interdigital extensional member 15 is provided between the extending portions 23 and 24 corresponding to the middle and ring fingers respectively.

The interdigital extensional member 15 is in the form of a strip extending from between the bases of the extending portions 23 and 24 located on both sides thereof longitudinally along the extending portions 23 and 24. The interdigital extensional member 15 has a length of about 30 mm to 50 mm, which is smaller than the lengths of the extending portions 23 and 24, and a width of about 10 mm to 20 mm, which is smaller than the widths of the extending portions 23 and 24, for example.

As shown in FIG. 4, the interdigital extensional member 15 is folded toward the back so that both side ends thereof are stitched on the back-side inner leather portion 13. Thus, the interval between the middle and ring finger portions 18 and 19 can be rendered larger than the intervals between the index and middle finger portions 17 and 18 as well as between the ring and little finger portions 19 and 20.

FIG. 2 shows the aforementioned inner leather member as viewed through the opening 11. As shown in FIG. 2, the back-side inner leather portion 13 has upright portions 14 stitched on the palm-side inner leather portion 12 to form space portions receiving the thumb and the fingers of the ball player between the back-side inner leather portion 13 and the palm-side inner leather portion 12 and vertically uprighted to define the space portions. The interdigital extensional member 15 is arranged between any of the upright portions 14, for extending the interval between the bases of the middle and ring finger portions 18 and 19. Thus, an extensional portion is formed between the bases of the middle and ring finger portions 18 and 19.

In the ball catching tool 1 according to Example 1, this extensional portion is arranged around the interdigital portion between the middle and ring fingers of the ball player, and brought into contact with a side portion around the bases located on the interdigital portion between the middle and ring fingers. Thus, the ball player wearing the ball catching tool 1 can fix the middle and ring fingers in the ball catching tool 1 while spreading the interval therebetween.

Therefore, the ball player can inhibit the aforementioned fingers from unnecessarily moving in the ball catching tool 1 when catching a ball, can readily efficiently transmit the power of his/her hand to the ball catching tool 1, and can also suppress fluctuation of the optimum position (pocket position) for receiving the ball. Consequently, the ball player can be efficiently inhibited from failing to catch the ball. The ball catching tool 1 according to Example 1 is particularly useful for an infielder.

EXAMPLE 2

Example 2 of the present invention is now described with reference to FIGS. 5 to 8.

Figure 5:
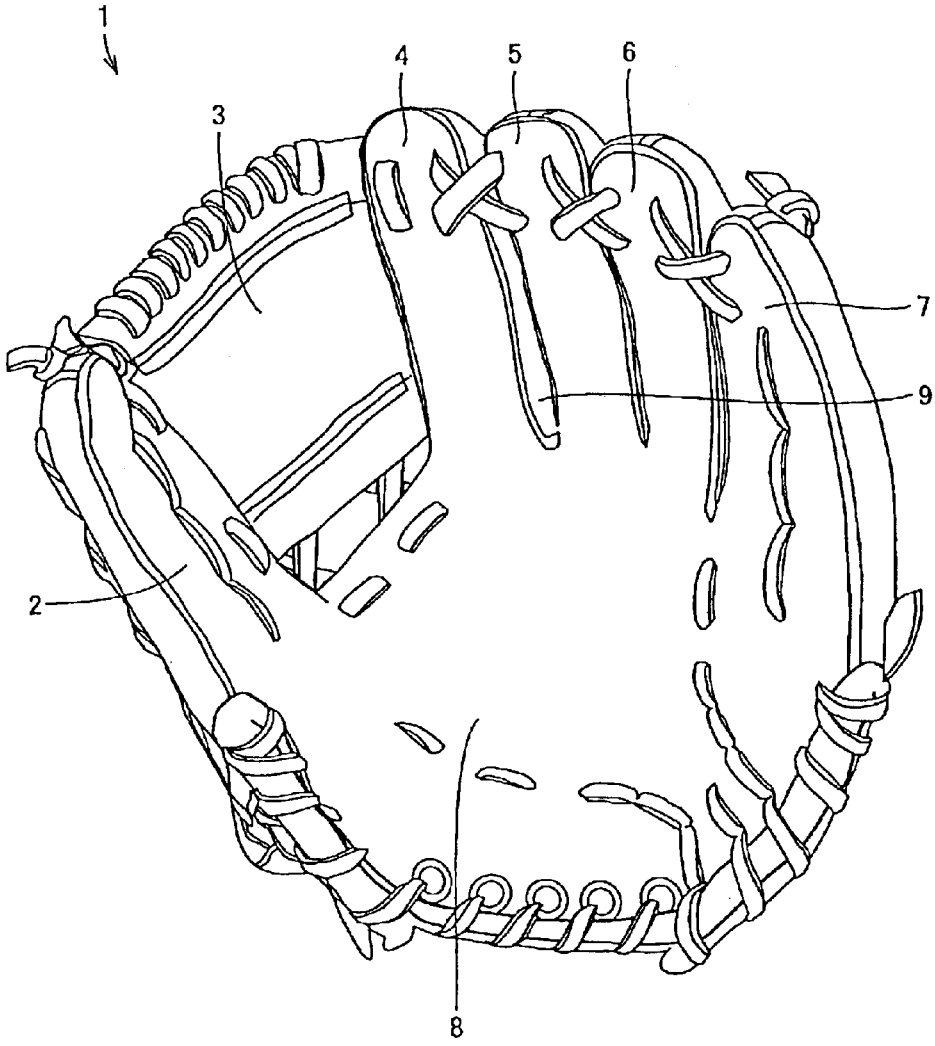
FIG. 5 is a front elevational view of a ball catching tool according to Example 2 of the present invention.
Figure 6:
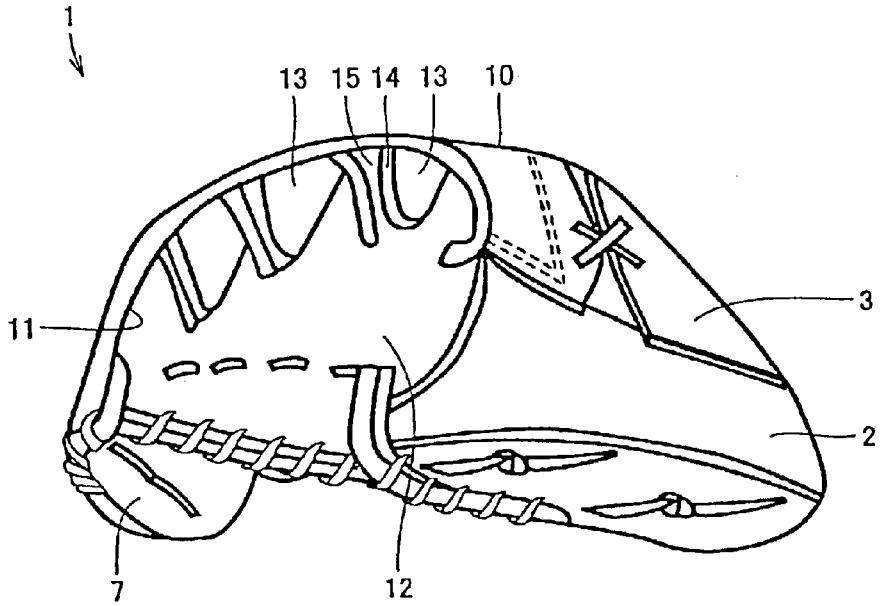
FIG. 6 illustrates the internal structure of the ball catching tool according to Example 2 of the present invention.
Figure 7:
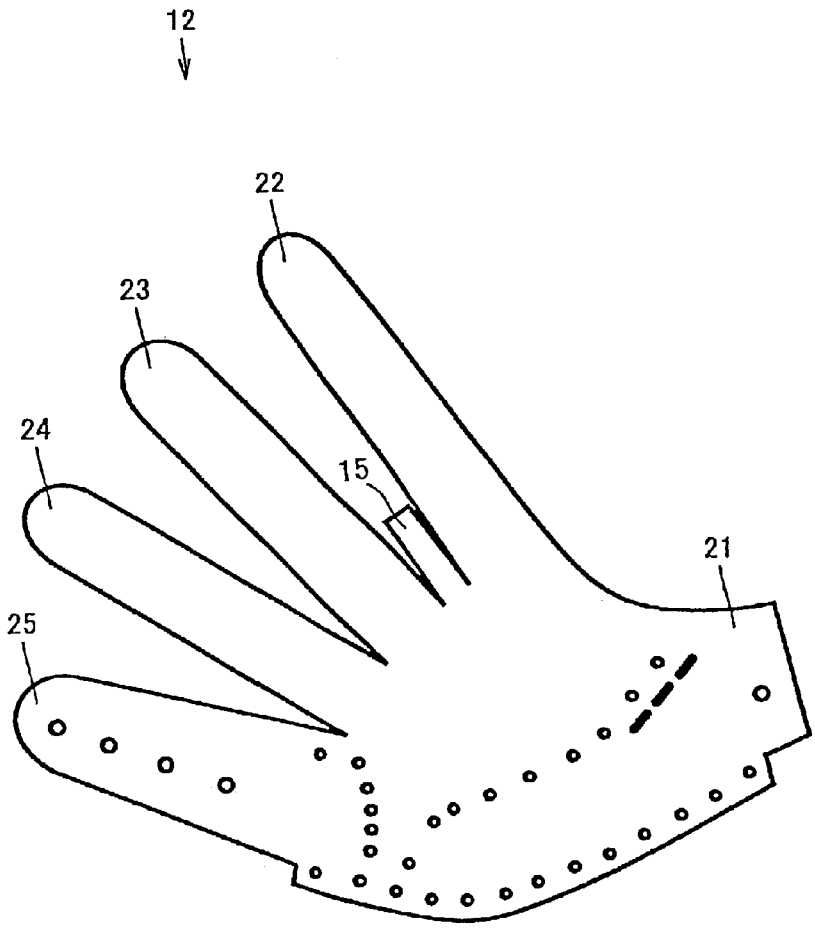
FIG. 7 is a plan view of a palm-side inner leather portion employable for the ball catching tool according to Example 2 of the present invention.
Figure 8:
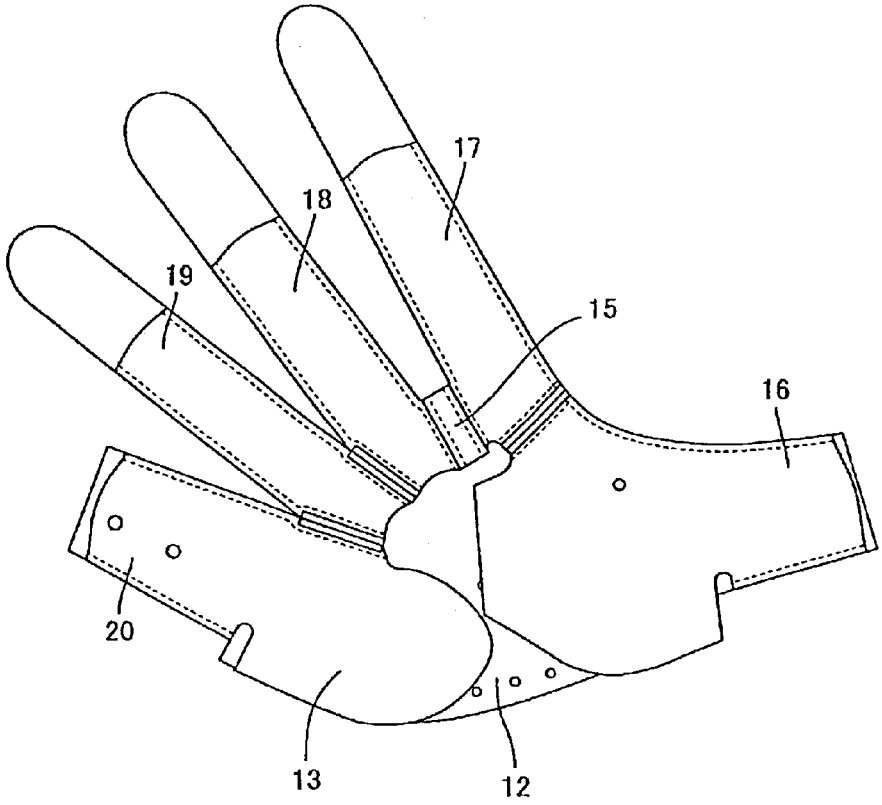
FIG. 8 is a plan view of an inner leather member of the ball catching tool according to Example 2 of the present invention.

In a ball catching tool 1 according to Example 2, a clearance 9 is defined between an index finger stall 4 and a middle finger stall 5 of an outer leather member, as shown in FIG. 5. As shown in FIG. 8, further, an interdigital extensional member 15 is stitched on a portion between the bases of an index finger portion 17 and a middle finger portion 18 of an inner leather member. Thus, an extensional portion can be formed between the bases of the index and middle finger portions 17 and 18. In order to define this extensional portion, the interdigital extensional member 15 is formed between the bases of extending portions 22 and 23 provided in correspondence to the index and middle fingers, as shown in FIG. 7. The remaining structure of the ball catching tool 1 according to Example 2 is basically similar to that of the ball catching tool 1 according to Example 1.

According to Example 2, a ball player wearing the ball catching tool 1 on his/her hand can fix the index and middle fingers in the ball catching tool 1 while spreading the interval therebetween. Therefore, the ball player can inhibit these fingers from unnecessarily moving in the ball catching tool 1 when catching a ball, can readily efficiently transmit the power of his/her hand to the ball catching tool 1, and can also suppress fluctuation of the optimum position for receiving the ball. Consequently, the ball player can be efficiently inhibited from failing to catch the ball. The ball catching tool 1 according to Example 2 is particularly useful for an outfielder.

According to the present invention, the ball player can fix the positions of desired ones of his/her thumb and fingers in the ball catching tool, whereby he/she can inhibit the thumb and the fingers from unnecessarily moving in the ball catching tool when catching a ball. Thus, the ball player can readily efficiently transmit the power of his/her hand to the ball catching tool, and can also suppress fluctuation of the optimum position (pocket position) for receiving the ball. Consequently, the ball player can be efficiently inhibited from failing to catch the ball.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A ball catching tool, for enabling a ball player to catch a ball, the ball catching tool comprising:

an outer leather member;

an inner leather member inserted in said outer leather member, wherein said inner leather member has a plurality of thumb and finger portions adapted for receiving the thumb and the fingers of a ball player, respectively, each of said thumb and finger portions having base portions;

said inner leather member having a back side inner leather portion;

an extensional portion is provided on at least one portion between said bases of said finger portions and extending the interval between said bases; and said extensional portion being attached to the back-side of said inner leather portion for spreading the interval between adjacent finger portions of said inner leather member.

2. The ball catching tool according to claim 1, wherein said thumb and finger portions have upright portions uprighted from a palm-side inner leather portion and arranged in the vicinity of interdigital portions between the thumb and the fingers, and said extensional portion is provided between said upright portions.

3. The ball catching tool according to claim 1, wherein said thumb and finger portions include a thumb portion adapted for receiving the thumb of a ball player, an index finger portion adapted for receiving an index finger of a ball player, a middle finger portion adapted for receiving a middle finger of a ball player, a ring finger portion adapted for receiving a ring finger of a ball player, and a little finger portion adapted for receiving a little finger of a ball player, and said extensional portion is provided between a base of said middle finger portion and a base of said ring finger portion.

4. The ball catching tool according to claim 1, wherein said thumb and finger portions include a thumb portion adapted for receiving the thumb of a ball player, an index finger portion adapted for receiving an index finger of a ball player, a middle finger portion adapted for receiving a middle finger of a ball player, a ring finger portion adapted for receiving a ring finger of a ball player, and a little finger portion adapted for receiving a little finger of a ball player, and said extensional portion is provided between a base of said index finger portion and a base of said middle finger portion.

5. The ball catching tool according to claim 1, wherein said outer leather member includes a plurality of thumb and finger stalls adapted for receiving the thumb and fingers of a ball player, respectively, and a clearance is provided between bases of said thumb and finger stalls on a position corresponding to said extensional portion.

6. A ball catching tool, for enabling a ball player to catch a ball, the ball catching tool comprising:

an outer leather member;

an inner leather member insertable into said outer leather member, said inner leather member including a palm-side inner leather portion located on the side of a palm, a back-side inner leather portion located on the side of a back, a plurality of thumb and finger portions adapted for receiving the thumb and fingers of a ball player respectively, each of said thumb and finger portions having interdigital portions and base portions;

a plurality of upright portions uprighted from said palm-side inner leather portion, said upright portions arranged in the vicinity of said interdigital portions between said thumb and finger portions; and at least one extensional portion provided between said upright portions, said extensional portion extending the interval between said bases of respective finger portions.

* * * * *